United States Patent [19]

Beyl

[11] 4,082,313

[45] Apr. 4, 1978

[54] SAFETY SKI BINDING

[76] Inventor: Jean Joseph Alfred Beyl, Boulevard Victor-Hugo, Nevers, Nièvre, France

[21] Appl. No.: 673,720

[22] Filed: Apr. 5, 1976

[30] Foreign Application Priority Data

Apr. 11, 1975 France ..... 75 11336

[51] Int. Cl.[2] ..... A63C 9/08

[52] U.S. Cl. ..... 280/618; 280/628

[58] Field of Search ..... 280/618, 620, 628, 627, 280/626, 630, 629, 632, 631, 617, 616, 613, 611

[56] References Cited

U.S. PATENT DOCUMENTS

| | | | |
|---|---|---|---|
| 3,326,567 | 6/1967 | Pronzati | 280/628 |
| 3,594,014 | 7/1971 | Salomon | 280/628 |
| 3,689,095 | 9/1972 | Salomon | 280/628 |
| 3,866,928 | 2/1975 | Gertsch et al. | 280/618 |
| 3,884,489 | 5/1975 | Gertsch et al. | 280/618 |
| 3,900,205 | 8/1975 | Sittmann | 280/618 |

*Primary Examiner*—Robert R. Song
*Assistant Examiner*—Milton L. Smith
*Attorney, Agent, or Firm*—Bierman & Bierman

[57] ABSTRACT

A safety ski binding comprises a movable plate for supporting a ski boot, and is mounted for pivotal movement in a plane parallel to the ski; toe-end and heel-end devices are adapted to retain the plate under normal skiing conditions against upward and lateral movements; the toe-end device comprises co-acting inclined and curved surfaces, and the heel-end device comprises a tilting arm pivotally mounted to a transverse pivot pin carried by a pintle mounted in turn for rotation about its axis perpendicular to the ski surface; spring-loaded members normally urge the tilting arm to its normal skiing, boot-retaining position; the plate is adapted to be released in all directions when subjected to excessive stress.

4 Claims, 18 Drawing Figures

IV
V
1
2
3
4
5
6
7
8
9
10
12
13
14
15
16
17
18
19

SAFETY SKI BINDING

BACKGROUND OF THE INVENTION

1. Field of the Invention

The present invention relates generally to safety ski bindings and has specific reference to a ski binding of the type comprising a movable plate adapted to support the corresponding ski boot. Said plate is pivotally and detachably mounted for movement in a plane parallel to the ski. This movable plate is retained on the ski by devices coacting with the toe- and heel-ends of the plate, one such device comprising a tilting locking member associated with resilient means so arranged that, in case of excessive effort exerted on the binding, the plate can be released in all directions with respect to the ski.

2. Description of the Prior Art

As a rule, the retaining device comprising this tilting locking member is mounted at the rear end of the movable plate. This device must be capable of retaining this plate in position when stresses of relatively short duration are exerted thereon, while permitting on the other hand the release of said movable plate when stronger and/or longer stresses are exerted thereon. However, it is also required that the resilient force counteracting the plate release movement have a different value according as the release is to take place in case of torsional effort or upwardly in case of a forward fall of the skier.

These various requirements make the construction of ski bindings of this type more complicated and the desired results cannot be obtained in all cases with hitherto known safety ski bindings.

DESCRIPTION OF THE INVENTION

It is therefore the essential object of the present invention to provide a safety ski binding of the type broadly set forth hereinabove which incorporates a retaining device capable of melting these various requirements by using relatively simple means operating with the maximum efficiency and reliability.

The safety ski binding according to this invention is characterized in that the tilting locking member of the retaining device incorporating this member comprises an arm fulcrumed about a horizontal pivot pin carried by the upper or outer end of a vertical pintle extending at right angles from the ski surface and adapted to rotate freely about its axis, and one or more movable members responsive to a resilient force provided by one or more springs retaining said arm against tilting forces and rotational forces as well as forces tending to move said arm in any other direction.

In a preferred form of embodiment of this invention the tilting arm extends longitudinally above a fixed case enclosing the resilient retaining means, and comprises on the plate side an extension bent towards the ski and responsive to said resilient force, the arm-supporting pintle being located at the opposite end of said case.

According to a modified form of embodiment of the safety ski binding of this invention, the resilient means for retaining the tilting arm comprises a coil compression spring housed within said arm and constantly urging a piston projecting from the arm end opposite said movable plate, said piston being normally engaged in a seat consisting of a central cavity formed in a fixed, cam-forming shaped surface registering with said piston.

In a further form of embodiment of this invention the retaining tilting arm is normally held in its operative or lower position by a pair of movable jaws responsive to one or more of springs and adapted to slide or pivot for releasing the tilting arm when relatively considerable efforts are exerted thereon.

However, other features and advantages of this safety ski binding will appear as the following description proceeds with reference to the attached drawings illustrating diagrammatically by way of example a few typical forms of embodiment thereof.

DESCRIPTION OF THE PREFERRED EMBODIMENTS

Figures 1, 2, 3:
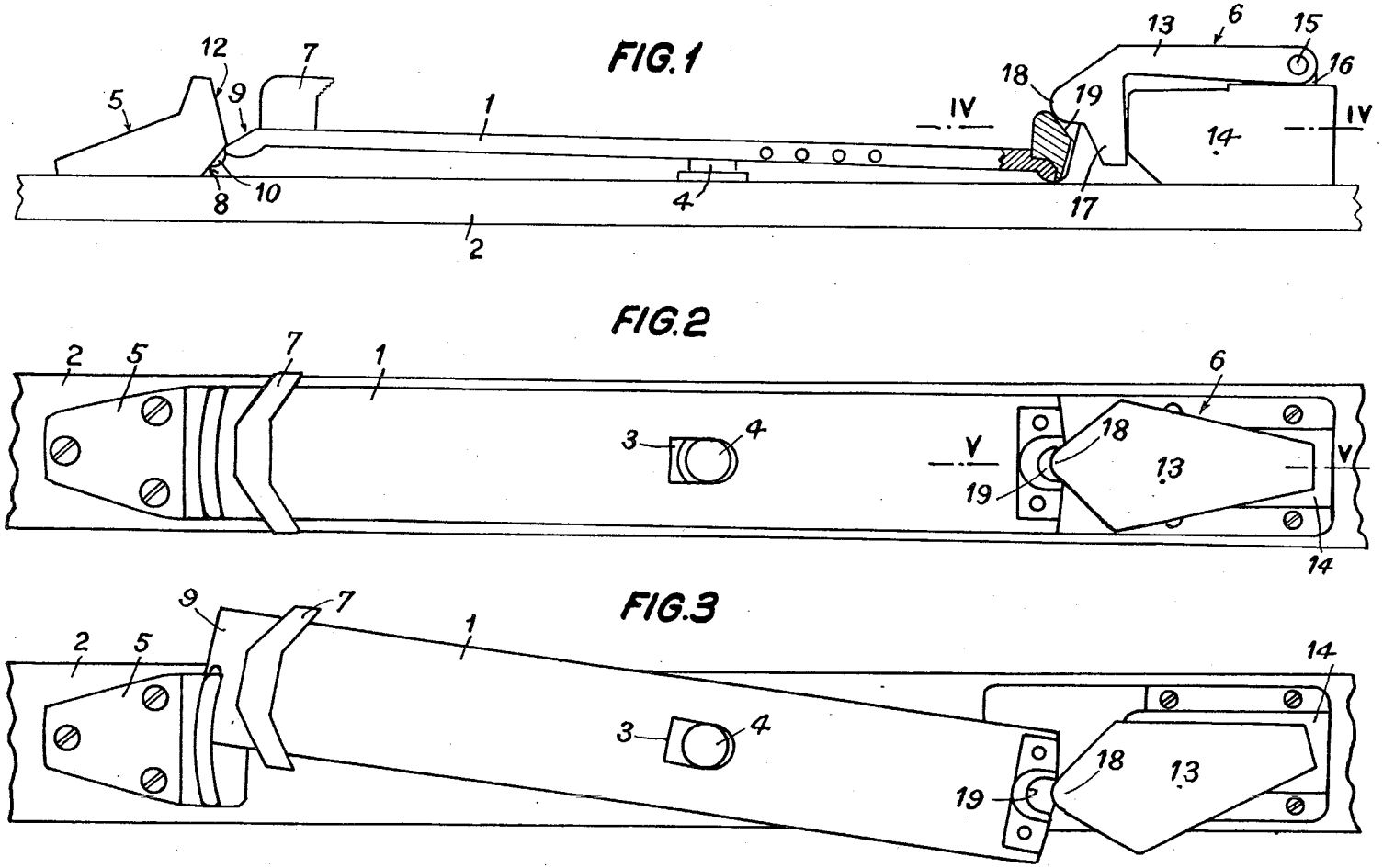
FIG. 1 is a side elevational view, with parts broken away, showing the movable plate in a position corresponding either to the positioning thereof on the top surface of the ski or to the vertical release of said plate in case of rearward fall of the skier.
FIG. 2 is a plan view from above of the ski binding illustrated in FIG. 1.
FIG. 3 is another plan view from above showing the movable plate during the release thereof as a consequence of an excessive torsional stress.
Figure 5:
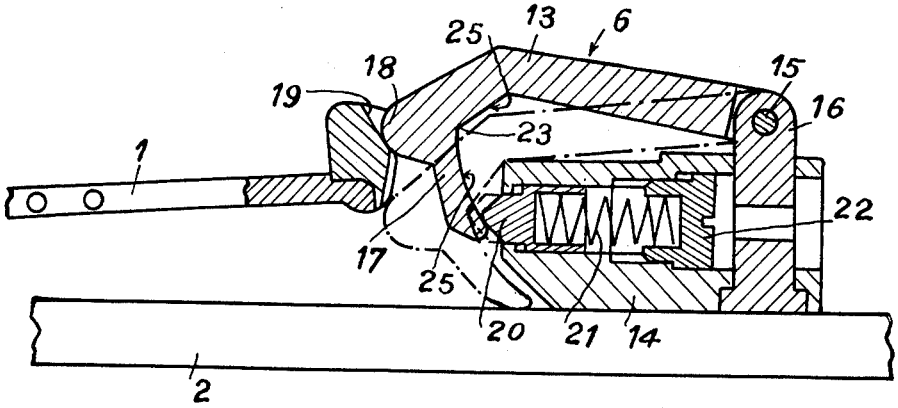
FIG. 5 is a fragmentary vertical section taken along the line V—V of FIG. 2, showing on a different scale the vertical release of the heel end of the movable plate.
Figure 4:
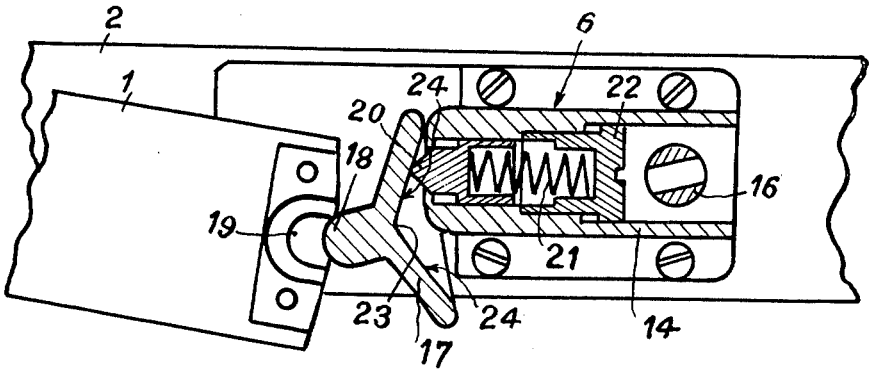
FIG. 4 illustrates the rear or heel-end release device during the same release movement, the device being shown in horizontal section taken along the plane IV—IV of FIG. 1 but on a different scale.

In the form of embodiment of the invention illustrated in FIGS. 1 to 5 of the drawings the safety ski binding comprises a plate 1 detachably mounted on the ski top 2. Intermediate its ends this plate 1 comprises an opening 3 for receiving a pivot member 4 rigid with the ski 2. Preferably, this pivot member 4 is located substantially in alignment with the tibia of the skier's leg. With this arrangement, the plate 1 can pivot on the ski about the fixed pivot member 4 in a plane parallel to the top surface of the ski. However, this plate 1 can also be removed completely from the ski by lifting its toe or heel end, or through any other movement away from the ski.

Plate 1 is normally retained on the ski by two retaining devices 5 and 6 located one at the toe end and the other at the heel end of the plate, respectively. On the other hand, the toe and heel ends of this plate are provided with means for holding the ski boot against movement. Thus, at the front a jaw 7 capable of clamping the toe end of the boot sole is provided. At the rear, the plate 1 may comprise for example a heel hold-down device of any known and suitable type, which is not shown in the attached drawings.

The front or toe retaining device 5 comprises an abutment member secured to the top surface of the ski and formed at its forward lower end with a recessed inclined surface 8 extending transversely to the ski and adapted to retain the toe end of the movable plate 1. For this purpose, the movable plate 1 is formed at its toe end with an inclined surface 9 matching that of said abutment member 5. Preferably, a spring loaded member, such as a ball 10, is provided centrally of the retaining surface 8, and the inclined surface 9 of plate 1 has formed in its center a cavity 11 adapted to receive said ball 10.

Above its retaining surface 8 the rear face of abutment member 5 comprises another inclined surface 12 inclined in the opposite direction. This second inclined surface 12 is intended for facilitating the engagement of the toe end of movable plate 1 under the retaining surface 8.

The heel-end retaining device 6 comprises a tilting arm 13 adapted to hold in position the corresponding end of plate 1. In its normal position this arm 13 extends substantially longitudinally above a fixed case 14 enclosing the resilient means necessary for retaining said arm in position. At its opposite end, i.e. opposite the plate 1, this arm 13 is pivotally mounted about a horizontal pin 15 carried by the top or outer end of a pintle 16 mounted in turn for free rotation on the ski. This pintle 16 is enclosed in the corresponding end portion of case 14 and extends at right angles to the top surface of the ski. It may also be noted that when the tilting arm 13 is in its normal position the pivot pin 15 extends across the longitudinal center line of the ski.

At its front end the tilting arm 13 comprises an extension 17 directed towards the ski. On its front surface this bent portion 17 of arm 13 carries a projecting nose 18 adapted to engage a shaped notch 19 formed at the rear end of the movable plate 1.

The resilient means enclosed in the fixed case 14 engages the rear face of the bent portion 17 of arm 13. It comprises a piston 20 slidably mounted for longitudinal movement, along an axis substantially parallel to the top surface of the ski. This piston 20 is responsive to a coil compression spring 21 reacting against a screw plug 22 permitting the adjustment of the prestress of said spring. The front end of piston 20 is tapered and projects from the fixed case 14. This front end normally engages a seat consisting of a central cavity 23 formed in a shaped, cam-forming portion of the registering surface of the bent portion 17 of tilting arm 13. It will be seen that in horizontal section this surface comprises a pair of oppositely inclined ramps 24 forming a V having a forwardly disposed apex (see FIG. 4). However, when seen in vertical section this shaped surface also comprises a pair of ramps 25 inclined in opposite directions and also forming a V having a forwardly directed apex. It is also apparent that the inclination of said ramps 24 and 25 differs so that the resilient forces counteracting the upward tilting movement of arm 13 and the pivotal movements of this arm 13 about its pintle 16, respectively, have different values.

Of course, the rear face of the bent portion 17 of arm 13 is shaped throughout its extent and said inclined ramps 24 and 25 merge through suitably shaped portions adapted to be engaged by the tapered tips of piston 20 during a corresponding movement of arm 13. In fact, the latter may obviously be led to perform composite rotational and tilting movements in the space. Thus, piston 20 will normally counteract these movements, provided that the magnitude of the effort involved remains within predetermined limits. However, in case of stronger and/or longer effort, the piston 20 will recede, thus permitting the movement of arm 13 and therefore the release of movable plate 1 either vertically (FIG. 5) or horizontally (torsion stress, FIGS. 3 and 4), or alternatively in directions resulting from composite movements.

FIGS. 6 to 10 illustrate a modified form of embodiment of the retaining device for the heel end of movable plate 1. In this arrangement the corresponding retaining arm **13*a* is also tiltably mounted about a horizontal pivot pin 15*a* carried by the top end of a pintle 16*a* mounted in turn for free rotation about its axis. The pintle 16*a* is held in position by the base plate 26 of a fixed bracket 27. It will be seen that in the present instance the tilting arm 13*a* is disposed between the branches of a strap 28 consisting of the upper portion of said pintle 16*a*, the pivot pin 15*a* being located intermediate the ends of arm 13*a*. In fact, this pivot pin 15*a* consists of a pair of trunnions formed on either side of arm 13*a* and engaging corresponding apertures formed in the branches of said strap 28**.

At its front end, the tilting arm **13*a* carries a nose 18*a* adapted to engage the shaped notch 19 formed in the rear end of plate 1**.

The resilient means contemplated for retaining this arm is housed within an axial bore formed in this arm. This bore is closed at its forward end and open at its rear end, and contains a coil compression spring **21*a* engaging a piston 20*a* disposed at the rear and carrying an end piece 29 projecting from the rear end of arm 13*a***.

The tip of this end piece 29 is substantially spherical and in the normal position of arm **13*a* it engages a seat 23*a* consisting of a central cavity formed in a shaped surface 30 at the rear end of bracket 27, this surface facing forwardly, i.e. towards the end piece 29 of piston 20*a***.

Figure 10:
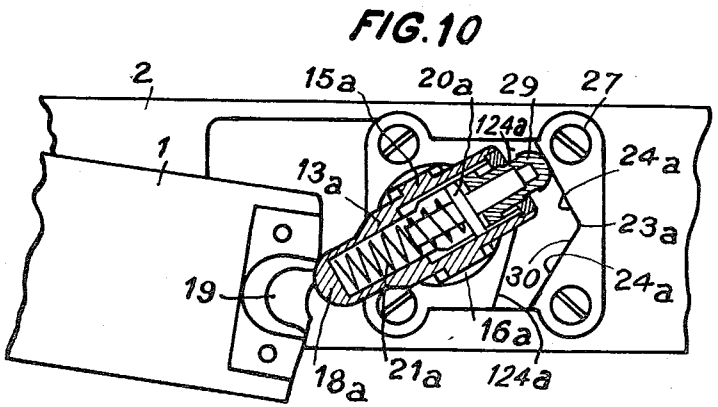
FIG. 10 is a horizontal section taken along the line X—X of FIG. 8, showing the torsional release of the movable plate.
Figure 9:
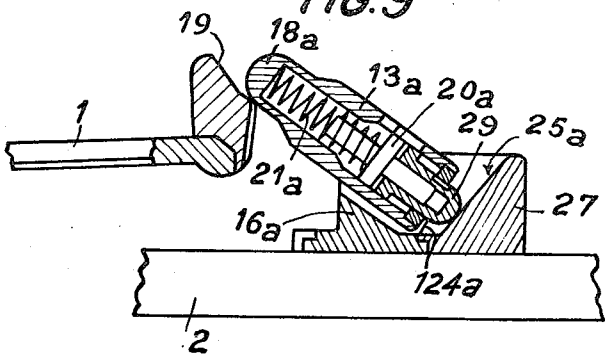
FIG. 9 is a similar sectional view illustrating the vertical release of the movable plate.
Figure 6:
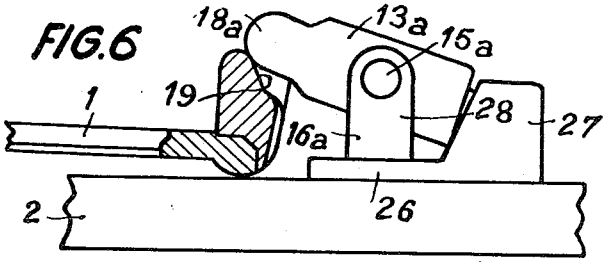
FIG. 6 is a fragmentary side elevational view of another form of embodiment of the retaining device provided at the rear or heel end of the movable plate.
Figure 7:
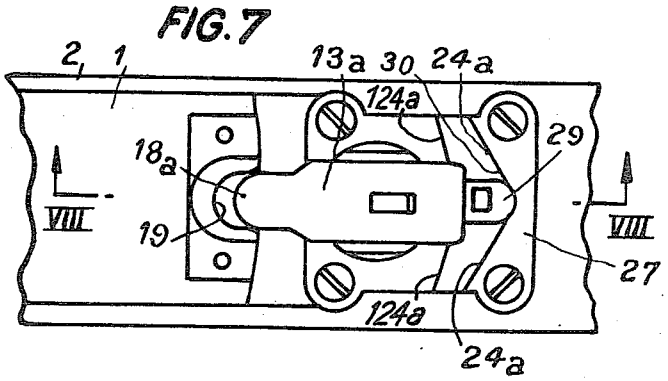
FIG. 7 is a plan view from above of the device shown in FIG. 6.
Figure 8:
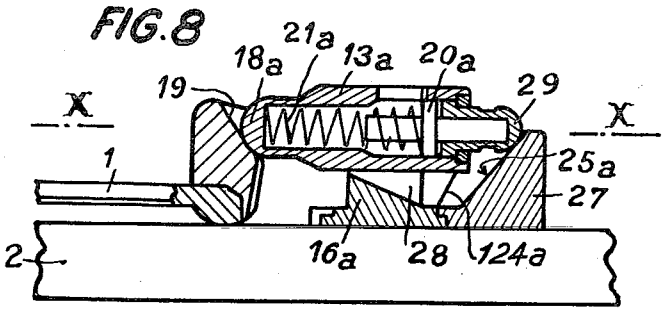
FIG. 8 is a vertical section taken along a plan VIII—VIII of FIG. 7.
Figure 14:
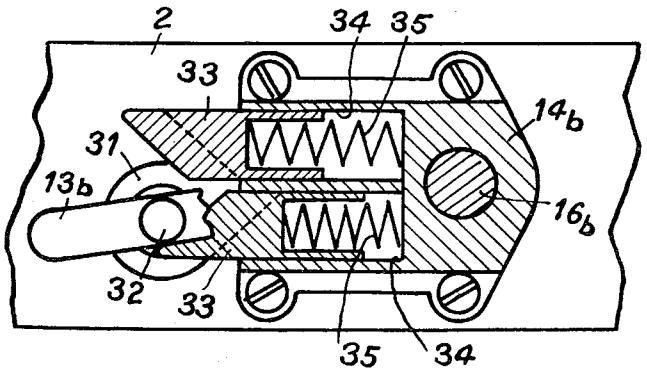
FIG. 14 is a horizontal section taken along the line XIV—XIV of FIG. 12, illustrating a torsional release position of the rear or heel-end of the movable plate.

As clearly apparent from the plan views of FIGS. 7 and 10 this shaped surface 30 comprises a pair of ramps or cam faces **24*a* diverging from each other and having a common apex at the rear. Therefore, the cam faces 24*a* are somewhat similar to the cam faces 24 of the preceding form of embodiment. The lower portion 124*a* of cam faces 24*a*** exhibit greater divergence than the upper portion.

On the other hand, as shown in vertical section the same shaped surface 30 comprises a single ramp or cam face 25*a* containing the center of said cavity 23*a*. Thus, the shaped surface 30 has a substantially dihedral configuration.

With this specific arrangement, the tilting arm 13*a* tends to be maintained in alignment with the longitudinal axis of the ski (see FIG. 7). However, when an excessive effort is exerted on the plate 1, the arm 13*a* can tilt about the pin 15*a* (see FIG. 9) or rotate with the pintle 16*a* (see FIG. 10). Of course, it may also accomplish composite tilting and pivoting movements. In these various circumstances the resilient means counteract the corresponding movements, the end piece 29 of piston 20*a* sliding along the corresponding portions of the shaped surface 30. In this respect, it may be emphasized that these portions have different inclinations in order to provide a resilient force varying according as the plate 1 is to be released as a consequence of a vertical movement or as a consequence of a torsional movement, or alternatively when a composite movement is exerted thereon.

The specific advantage resulting from this modified form of embodiment is that it avoids an increase in the elastic resistance counteracting rotational movement when there is partial upward movement of the retaining nose 18*a* and the accompanying downward movement of end piece 29. When end piece 29 is in the downward position, the spring 21*a* is subject to greater compression and thus exerts greater force on cam surface 30. However, the greater divergence of cam faces 24*a* at their lower portion 124*a* reduces their resistance to rotational movement. Consequently, the additional force exerted on cam surface 30 by the compression of spring 21*a* when end piece 29 is tilted downward will not result in increased resistance to rotational movement.

Thus, for instance, the angle between the cam face and the apex of end piece 29 may be 60° in the case of a simple rotational movement. On the other hand, if a forward fall effort causes the end piece 29 to be lowered for example by 5 millimeters until a torsion stress develops, this end piece 29 will meet only a cam face angle of lower value, for instance 80°. Therefore, in this case the resilient force counteracting the movement will be lesser than in the case of a simple rotational movement.

FIGS. 11 to 14 illustrate another form of embodiment of the invention, wherein the corresponding tilting arm 13*b* is pivoted at its rear end to a pivot pin 15*b* carried by the upper end of a pintle 16*b* adapted to rotate freely on the ski. This pintle is mounted in turn within a case 14*b* secured to the ski and containing the resilient means for retaining the arm 15*b*.

This device controls a frustoconical member 31 carried by a concentric screw 32 extending through the front end of, and screwed in, the arm 13*b*, the frustoconical member 31 being disposed beneath said front end.

The frustoconical member 31 is retained in the position corresponding to the lowering of said arm 13*b* by a pair of jaws 33 slidably mounted in a pair of corresponding bores 34 formed in the case 16*b* and parallel to the longitudinal axis of the ski, on either side of this axis. Each piston is responsive to a coil compression spring 35 enclosed in the corresponding bore 34.

Figure 13:
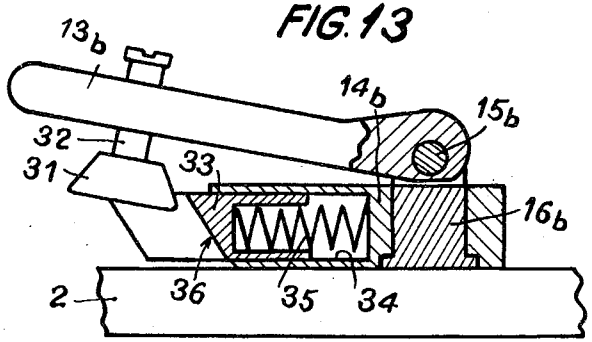
FIG. 13 is a similar sectional view showing a vertical release position of the movable plate.
Figure 11:
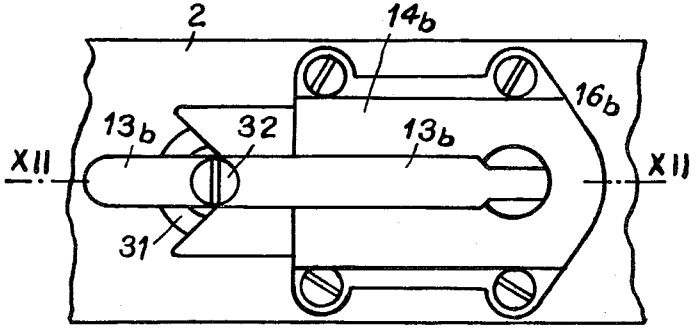
FIG. 11 is a plan view from above showing a modified form of embodiment of the retaining device provided at the heel end of the movable plate.
Figure 12:
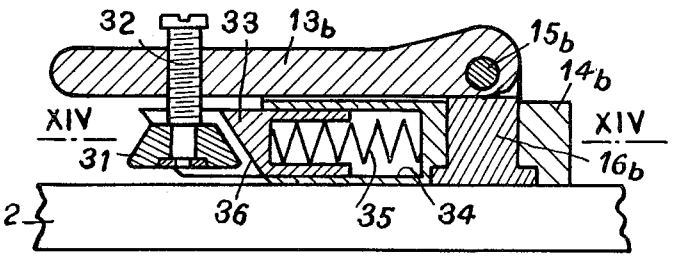
FIG. 12 is a vertical section taken along the line XII—XII of FIG. 11.

These two jaws are adapted to retain the frustoconical member 31 through their front ends. When seen in plan view, these jaws 33 are bevelled to form a V having a rearwardly directed apex (see FIG. 11). However, the front faces 36 of these jaws 33 are also inclined, as illustrated in FIGS. 12 and 13.

Thus, the jaws 33 normally keep the arm 13*b* in its lower position. However, in case of extraordinary and/or prolonged efforts, either or both of these jaws will recede to release the frustoconical member 31 and consequently the tilting arm 13*b*.

In this respect, it will be seen that in case of forward or rearward fall of the skier, the pair of jaws 33 will be moved backwards, so that the resilient force counteracting the release of arm 13*b* will cause the pair of springs 35 to become operative. On the other hand, in case of torsional movement, only one jaw will recede whereby the resilient force will be lesser than in the preceding case. Moreover, in a composite torsional/tilting movement, only one spring will be operative, thus reducing the resilient force counteracting the release of the movable plate 2 and therefore the ski boot.

Figure 15:
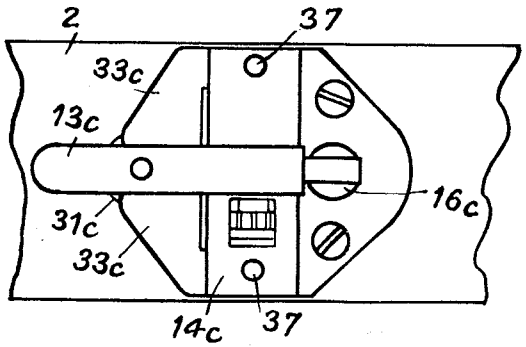
FIG. 15 is a plan view from above showing another possible form of embodiment of a retaining device for the heel end of the movable plate.
Figure 16:
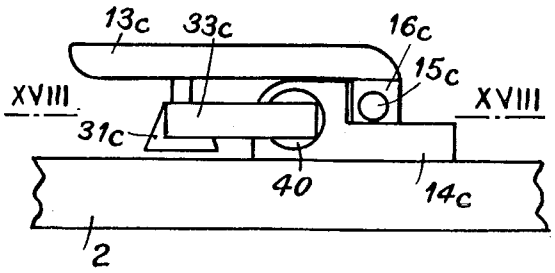
FIG. 16 is a side elevational view of the device of FIG. 15.

FIGS. 15 to 18 illustrate a modified form of embodiment wherein the corresponding tilting arm 13*c* is also retained in its lower position by a pair of jaws 33*c* coacting with a frustoconical member 31*c* carried by the front end of this arm. However, in this assembly the jaws 33*c* are pivotally mounted on a pair of pivot pins 37 instead of being mounted for longitudinal sliding movement. Each jaw 33*c* is adapted to move away from the frustoconical member 31*c* so as to release it by pivoting about the corresponding pivot pin 37. These pivot pins 37 extend at right angles to the top surface of the ski 2 and are carried by a case 14*c* comprising a transverse bore 38 in which a single coil compression spring 39 engages a pair of pistons 40 disposed on either side of said spring. Each piston is adapted to keep the corresponding jaw 33*c* in its normal position, that is, the position in which they retain the frustoconical member 31*c*, as shown in FIG. 15. For this purpose, the rear end of each jaw comprises a flat face 41 normally engaged by the corresponding piston 40.

However, in case of considerable and/or prolonged stress, either or both of said jaws 33*c* can pivot to release the frustoconical member 31*c* and consequently the arm 13*c*.

Figure 18:
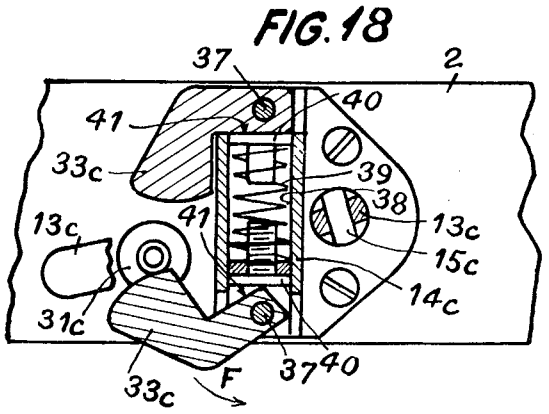
FIG. 18 is a horizontal section taken along the line XVIII—XVIII of FIG. 16, illustrating a torsional release position of said movable plate.
Figure 17:
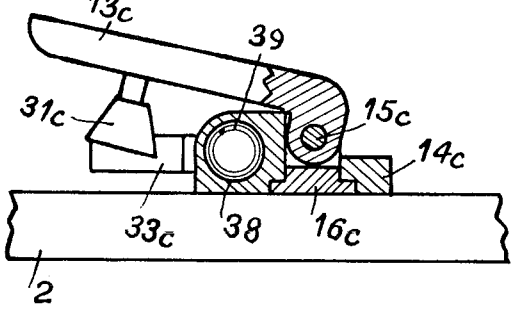
FIG. 17 is a similar view with parts broken away, showing the vertical release position of the movable plate.

It will be seen that in this modified form of embodiment of the safety ski binding of this invention a single spring is provided for holding both jaws. However, in case of a simple forward fall not attended by any accessory torsional movement, this spring is compressed simultaneously at both ends, for both jaws 33*c* must pivot in opposite directions for releasing the frustoconical member 31*c* (see FIG. 17). In case of composite movement accomplished by the skier's foot, this spring will be compressed at one end only, so that its resilient force is reduced accordingly. In fact, in this case the outward pivotal movement of a single jaw 33*c* is sufficient, i.e. in the direction F as shown in FIG. 18. The same applies in case of a simple torsional release.

Of course, many other modifications and changes may be brought to the safety ski binding shown and illustrated herein by way of example, without departing from the basic principles of the invention which are set forth in the appended claims. In fact, the foregoing discloses only a few forms of embodiment given by way of illustration, as will readily occur to those conversant with the art.

What I claim is:

1. In a safety ski binding having an elongated ski boot support plate rotatably mounted on a pivot adapted to be secured to the ski, and having binding means at the front and rear ends of said plate for holding the boot thereon, the combination of a fixed abutment mounted on said ski and adapted to engageably retain one end of said plate, and resilient retaining means mounted on said ski registering with the opposite end of said plate for maintaining said plate in its normal operative position while permitting movement of the plate away from the ski, said resilient retaining means comprising a pintle mounted perpendicularly on said ski adjacent to but spaced from the opposite end of said plate, a locking arm tiltably mounted on the upper end said pintle and at one end normally engaging the said opposite end of said plate for retaining said plate on said ski, means forming a cam surface mounted on said ski adjacent the other end of said locking arm and a spring-loaded piston projecting from the other end of said locking arm and engaging said cam surface, said cam surface having two different contours being shaped to impart to said plate through the one end of said locking arm release forces of different values against both lateral rotational movement and upward pivotal movement of said locking arm.

2. In a safety ski binding having an elongated ski boot support plate rotatably mounted on a pivot adapted to be secured to the ski, and having binding means at the front and rear ends of said plate for holding the boot thereon, the combination of a fixed abutment mounted on said ski and adapted to engageably retain one end of said plate, and resilient retaining means mounted on said ski registering with the opposite end of said plate for maintaining said plate in its normal operative position while permitting movement of the plate away from the ski, said resilient retaining means comprising a pintle mounted perpendicularly on said ski adjacent to but spaced from the opposite end of said plate, a locking arm tiltably mounted on the upper end of said pintle and at one end normally engaging the said opposite end of said plate for retaining said plate on said ski, means forming a pair of jaws on said retaining means and having opposing cam surfaces on their respective operative ends, a member carried by said locking arm normally positioned between said jaws and spring means urging said jaws against said member, for holding said locking arm whereby said jaws release said locking arm when a selective force is exerted thereon.

3. Ski binding according to claim 2 in which said jaws are individually and longitudinally slidably mounted under the action of said spring means, and in which the operating ends of said jaws about said member are beveled to form a V-shaped opening between them and are each provided with downwardly inclined faces, whereby a release movement in the vertical direction takes place against the resilient force of said spring means transmitted against both said jaws, and a torsional release movement takes place against the resilient force of said spring means transmitted through one or the other of said jaws.

4. Ski binding according to claim 2 in which said jaws are individually pivotally mounted for movement transversely of said ski, whereby a vertical release movement causes the pivotal movement of both jaws against said spring means, and a torsional release movement causes pivotal movement of one or the other of said jaws against said spring means.

* * * * *